US005353483A

United States Patent [19]

Louviere

[11] Patent Number: 5,353,483

[45] Date of Patent: Oct. 11, 1994

[54] METHOD AND APPARATUS FOR QUICKLY SECURING A LACED SHOE

[76] Inventor: Donald L. Louviere, 1141 Cooper Dr., Naples, Fla. 33940

[21] Appl. No.: 85,624

[22] Filed: Jul. 6, 1993

[51] Int. Cl.[5] ..... A43B 11/00; A43C 1/00

[52] U.S. Cl. ..... 24/712.1; 24/71 SK; 24/712.6; 24/713.6; 36/50.1

[58] Field of Search ..... 24/71 SK, 69 SK, 68 SK, 24/70 SK, 712, 712.1, 712.2, 713.6, 712.6; 36/50.1, 50.5, 51

[56] References Cited

U.S. PATENT DOCUMENTS

| | | | |
|---|---|---|---|
| 808,028 | 12/1905 | Ellis | 24/71 SK |
| 965,930 | 8/1910 | Perkins | 24/712.1 |
| 2,266,083 | 12/1941 | Rzepa | 24/267 |
| 3,200,458 | 8/1965 | Marzocchi | 24/71 |
| 3,279,015 | 10/1966 | Henning | 24/117 |
| 3,600,761 | 8/1971 | Mathey | 24/71 |
| 4,079,527 | 3/1978 | Antonious | 36/50.1 |
| 4,081,916 | 4/1978 | Salisbury | 36/50 |
| 4,414,761 | 11/1983 | Mahood | 36/50 |
| 4,451,995 | 6/1984 | Antonious | 36/51 |
| 4,541,147 | 9/1985 | Olivieri | 24/69 SK |
| 4,628,622 | 12/1986 | McBarron | 36/50.1 |
| 4,999,889 | 3/1991 | LeCouturer | 24/713.2 |
| 5,027,482 | 7/1991 | Torppey | 24/712.1 |
| 5,129,130 | 7/1992 | Lecouturier | 24/712 |

FOREIGN PATENT DOCUMENTS

| | | | |
|---|---|---|---|
| 1374132 | 8/1964 | France | 24/68 SK |

*Primary Examiner*—Victor N. Sakran

*Attorney, Agent, or Firm*—Merrill N. Johnson

[57] ABSTRACT

Method and apparatus for lacing and securing a shoe onto the foot using an elongated lace and the five spaced apart holes in the shoe's collar on each side of the shoe's tongue. A two part fastening clip includes a flat rectangular clip base having spaced apart eyelets and an elongated slot and a clip lever designed to mate in hinged relation with the clip base by insertion of an enlarged cylindrical edge portion of the clip lever into the elongated slot of the clip base and also having spaced apart eyelets. The shoe lace passes through the shoe's holes on opposite sides of the tongue, through the eyelets in the clip base, through the eyelets in the base, through the eyelets in the clip lever, and finally through the adjacent hole in the shoe collar. Then the two ends of the lace are securely tied together leaving sufficient slack to permit the foot to be inserted into the shoe. The clip base and the clip lever are hingedly joined together by inserting the clip lever's enlarged cylindrical edge into the slot in the clip base and the clip lever is secured flat against the clip base by locking means, thereby securing the laced shoe onto the foot.

4 Claims, 1 Drawing Sheet

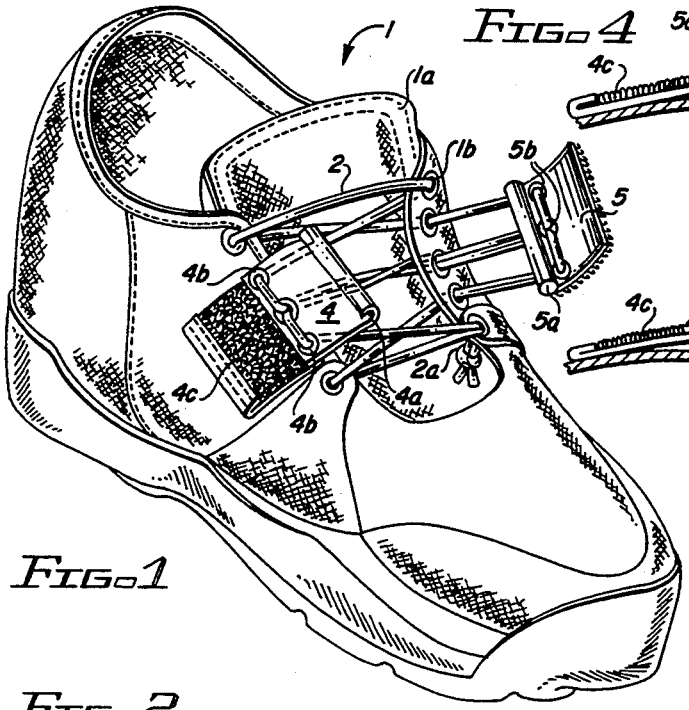
FIG. 1
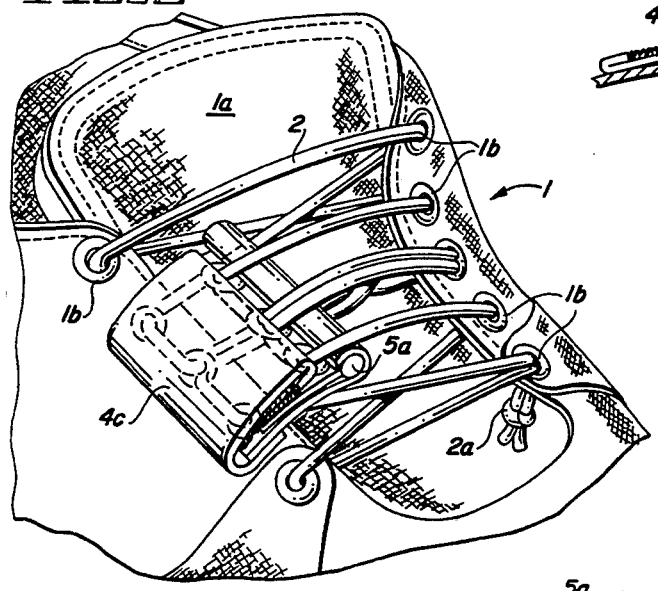
FIG. 2
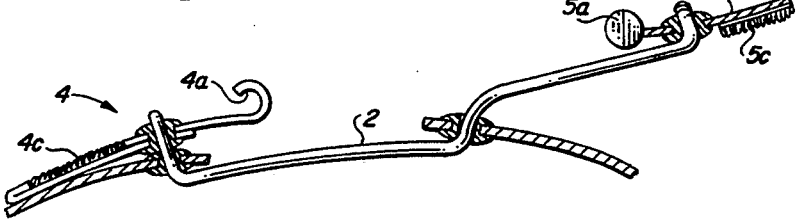
FIG. 3
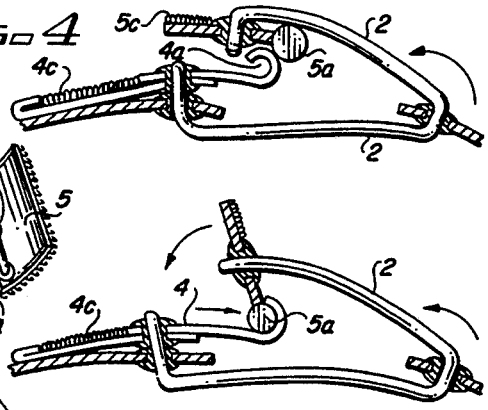
FIG. 4
FIG. 5
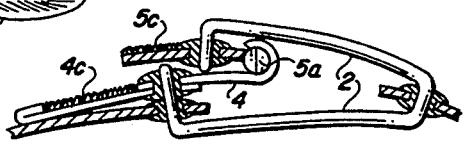
FIG. 6
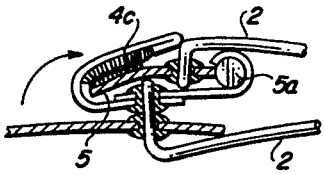
FIG. 7

METHOD AND APPARATUS FOR QUICKLY SECURING A LACED SHOE

My invention lies in the field of shoes and relates to a unique method and apparatus for quickly and positively securing a laced shoe to the foot with a predetermined tension on the shoe's lace.

BACKGROUND AND SUMMARY OF THE INVENTION

Conventionally a laced shoe employs a single elongated lace threaded from the bottom of the shoe's collar through two rows of equally spaced apart eyelets located on opposite sides of the shoe's tongue. The two ends of the lace are pulled tight and tied in a bow to secure the shoe to the foot.

Each time the shoe is removed, the two ends of the lace are untied and the lace is loosened from its tied position so that the shoe can be slipped off the foot.

Then when the shoe is to be worn, the lace is loosened between several of the eyelets to enable the shoe to be comfortably slipped onto the foot, the two ends of the lace are then pulled to take up the slack in the lace and the two ends are tied together.

Often times, especially with athletic or sportswear shoes used for running, tennis, basketball and other athletic events, the lace must be carefully adjusted to effect the proper tension of the tied lace and the shoe onto the foot. This takes time and requires an individual readjustment of the length of the lace between eyelets each time the shoe is put onto the foot.

My invention is uniquely designed to be attached to the laces of any footwear and it allows the user to tighten or loosen the shoe's fit over the foot in a single smooth motion. My invention which I call SNAPS TM thereby eliminates the present time-consuming need to adjust individual laces to achieve the necessary fit. While my invention may be used with most laced footwear styles, its primary market is in the sportswear field.

The SNAPS TM is a two-part clip with a hinge-like configuration and comprising a lower clip base joined at its front edge to an upper clip lever by a ball and socket type connection which closes with a swivel motion. A series of holes acting as eyelets are incorporated within both the clip base and clip lever which correspond with the eyelets on the shoe's collar. These holes allow the shoe lace to be threaded directly from the shoe's corresponding eyelets, thereby attaching and securing both the clip base and the clip lever to opposite sides of the shoe's collar.

In order to join the clip lever to the clip base, the clip lever and attached laces are mechanically transversed over the tongue of the shoe and the balled edge of the clip lever is inserted into the slotted edge of the clip base. The clip lever is then folded over, thereby taking up the lace slack, and secured by means of a male-female snapping mechanism such as a velcro flap on the clip base folded over and pressed onto a velcro patch on the clip lever. SNAPS TM is designed to be a one-handed operation.

The preferred velcro flap and patch serves as an additional safety measure against accidental disengagement. However, none of the lace tension is directly supported by the velcro flap.

The amount of tension required for SNAPS TM to perform its function is predetermined during the initial fitting, when the lace is fed through the clip base and the clip lever following the lace routing directions. The lace slack is quickly and conveniently removed when SNAPS TM is placed in its closed position.

DESCRIPTION OF THE DRAWINGS

FIG. 1 is a perspective view of a shoe fitted with a two part fastening clip according to a preferred form of my invention.

FIG. 2 is a detail of the shoe in FIG. 1 showing the two parts of the fastening clip fastened together to secure the laced shoe on the foot.

FIG. 3 is a detailed view of the two parts of the clip laced onto the shoe as shown in FIG. 1.

FIG. 4 is a detailed view showing the two parts of the clip being drawn together.

FIG. 5 is a detailed view showing the mating of the two parts of the clip together.

FIG. 6 is a detailed view showing the two parts of the clip secured together along side the shoe as shown in FIG. 2.

FIG. 7 is a detailed view showing the two parts of the clip with the flap of the clip base folded over the clip lever to securely lock them together.

DETAILED DESCRIPTION OF A PREFERRED EMBODIMENT OF THE INVENTION

Referring first to FIG. 1 of the drawings, an athletic shoe 1 is shown with my two part fastening clip attached to shoe 1 by means of lace 2. My fastening clip comprises two rectangular and preferably convexly curved parts, clip base 4 and clip lever 5.

Each of clip base 4 and clip lever 5 contains three eyelets **4*b* and 5*b* respectively as shown in FIG. 1 spaced apart along the base or lever similar to the spacing between eyelets 1*b* on the shoe's collar on opposite sides of the shoe's tongue 1*a***.

One edge of clip base 4 is curved back upon itself to form an open faced elongated socket or slot **4*a* and one edge of clip lever 5 is enlarged to form an elongated cylindrical in cross section edge 5*a* designed to fit in hinged relation within the elongated slot 4*a* in clip base 4**.

Attached to the edge of clip base 4 opposite slot **4*a* is a flexible flap 4*c* of hook and eye material such as velcro and mounted on the upper face of clip lever 5 away from its elongated edge 5*a* is a strip 5*c* of hook and eye material designed to interlock with the hook and eye material on flap 4*c* of clip base 4** after the two parts of the clip are joined together.

Although the lace 2 can be threaded into eyelets **1*b* on opposite sides of the shoe's tongue 1*a* and the eyelets 4*b* in the clip base 4 and in eyelets 5*b* in the clip lever starting from the bottommost eyelets 1*b* or from the uppermost eyelets 1*b*, preferably as shown in FIGS. 1 and 2 lacing begins by inserting the ends of lace 2 into the uppermost eyelets 1*b* with the midpoint of lace 2 spanning the space between the two uppermost eyelets 1*b* as shown in FIGS. 1 and 2**.

Now pass the opposite ends of lace 2 from the bottom of eyelet **1*b* through that eyelet on the opposite side of tongue 1*a* and then through the uppermost eyelet of either clip base 4 of clip lever 5 as shown in FIG. 1**.

Referring now to that end of the lace passed through the uppermost eyelet **4*b*, now thread the lace through the middle eyelet 4*b* in the clip base, then through the adjacent eyelet 1*b* on the same side of tongue 1*a*, then through eyelet 1*b* on the opposite side of the tongue, then through middle eyelet 5b of the clip base, then through the lowermost eyelet 5b, then through the adjacent eyelet 1b and finally from its top through the lowermost eyelet 1b on the opposite side of tongue 1a**.

Referring now to the opposite end of lace 2 passed through the uppermost eyelet of clip lever 5, now thread the lace through the middle eyelet 5b of the clip lever, then through the adjacent eyelet 1b on the same side of tongue 1a, then across the tongue and through the eyelet 1b on the opposite side of the tongue, then through middle eyelet 4b of the clip base, then through the lowermost eyelet 4b, then through the adjacent eyelet 1b on the same side of the tongue, then diagonally across the tongue and from its top down through the lowermost eyelet 1b on the opposite side of the tongue.

The two ends of lace 2 are now tied together by knot 2a as shown in FIGS. 1 and 2. Knot 2a should be positioned with sufficient play or slack in the lace, as shown in FIG. 1, to permit the wearer of shoe 1 to comfortably slip his or her foot into the shoe. However, knot 2a should also be positioned so that when the two parts of the fastener clip are joined and locked together as shown in FIG. 2, the lace achieves the desired tension of the shoe on the wearer's foot.

FIGS. 3 through 7 illustrate the successive steps taken to join and then lock together clip base 4 and clip lever 5 from their positions shown first in FIG. 1 and finally in FIG. 2. With shoe 1 on the wearer's foot, the wearer grasps clip lever 5 and as shown in FIG. 4 pulls it transversely across the shoe's tongue and then as shown in FIG. 5 inserts elongated edge 5a of the clip lever into slot 4a of the clip base. Then as shown in FIGS. 5 and 6 the clip lever is pressed down onto the clip base resting against the shoe. Finally, flap 4c of the clip base is folded over and the two hook and eye surfaces pressed together to securely lock clip base 4 and clip lever 5 into the position shown in FIG. 7.

Other means such as male-female button snaps may be used to lock the two parts of my fastener clip together. Preferably the two parts of the clip are made of high density molded plastic material, but they may be made of metal. While I have shown clips with three eyelets in the base and lever, clips with as few as two eyelets or as many as five may be used with various sizes and types of shoes.

While I have illustrated and described a preferred embodiment of my method and apparatus for quickly securing a laced shoe to the foot, various changes and modifications will become apparent to those skilled in the art and the spirit and scope of my invention is limited only by the appended claims.

I claim:

1. In a method of lacing and securing onto the foot a shoe having an elongated lace and at least five spaced apart holes in the shoe's collar on each side of the shoe's tongue designed to receive the lace, a solid rectangular clip base having near one side of the base three eyelets spaced apart similar to the spacing between the holes in the shoe's collar and on its opposite side having an elongated slot, a solid rectangular clip lever designed to mate in hinged relation with the clip base by insertion of an enlarged cylindrical edge portion of the clip lever into the elongated slot of the clip base, said slip lever also having three eyelets spaced similar to the eyelets in the slip base, the shoe lace passing through one pair of the shoe's holes on opposite sides of the tongue and then one end of the shoe lace passing through the next adjacent hole on the opposite side of the tongue, then through one of the eyelets in the clip base, then through the middle eyelet in the base, then through the next adjacent hole in the coller, then through the adjacent hole on the opposite side of the tongue, then through the middle eyelet in the clip lever, then through an adjacent eyelet in the clip lever, then through the next adjacent hole on the same side of the collar, the opposite end of the lace being put through the lower most adjacent hole in the collar on the opposite side of the tongue, then through the lowermost eyelet in the clip lever, then through the middle eyelet in the clip lever, then through the adjacent hole in the same side of the collar, then through the hole on the opposite side of the tongue, then through the middle eyelet in the clip base, then through the adjacent eyelet in the clip base, and finally through the adjacent hole in the shoe collar, then the two ends of the lace are securely tied together leaving sufficient slack in the lacing of the shoe to permit the foot to be inserted into the shoe, then the clip base and clip lever are hingedly joined together by inserting the clip lever's enlarged cylindrical edge into the slot in the slip base and the clip lever is secured flat against the clip base by locking means, thereby securing the laced shoe onto the foot.

2. In a method of lacing and securing onto the foot a shoe having an elongated lace and at least five spaced apart holes in the shoe's collar on each side of the shoe's tongue designed to receive the lace, a solid flat rectangular clip base having near one side of the base at least two eyelets spaced apart similar to the spacing between the holes in the shoe's collar and on its opposite side having an elongated slot, a solid rectangular clip lever designed to mate in hinged relation with the clip base by insertion of an enlarged cylindrical edge portion of the clip lever into the elongated slot of the clip base, said clip lever also having at least two eyelets spaced similar to the eyelets in the clip base, the shoe lace passing through one pair of the shoe's holes on opposite sides of the tongue and then one end of the shoe lace passing through the next adjacent hole on the opposite side of the tongue, then through one of the eyelets in the clip base, then through the next adjacent eyelet in the base, then through the next adjacent hole in the collar, then through the adjacent hole on the opposite side of the tongue, then through the next adjacent eyelet in the clip lever, then through the next adjacent hole on the same side of the collar, the opposite end of the lace being put through the lower most adjacent hole in the collar on the opposite side of the tongue, then through the lowermost eyelet in the clip lever, then through the next adjacent eyelet in the clip lever, then through the adjacent hole in the same side of the collar, then through the hole on the opposite side of the tongue, then through the next adjacent eyelet in the clip base, and finally through the adjacent hole in the shoe collar, then the two ends of the lace are securely tied together leaving sufficient slack in the lacing of the shoe to permit the foot to be inserted into the shoe, then the clip base and the clip lever are hingedly joined together by inserting the clip lever's enlarged cylindrical edge into the slot in the clip base and the clip lever is secured flat against the clip base by locking means, thereby securing the laced shoe onto the foot.

3. A fastening clip for securing a laced shoe onto a foot comprising a solid convexly curved rectangular clip base having along one side of the base at least two eyelets equally spaced apart along a straight line parallel to the one side, the opposite edge of the base being curved back to form an elongated slot, and a solid convexly curved rectangular clip lever designed to mate in hinged relation with the clip base by insertion of an enlarged cylindrical edge of the clip lever into the elongated slot of the clip base, the clip lever also having at least two eyelets spaced similar to and parallel with the eyelets in the clip base, and the clip base and the clip lever each having mounted thereon cooperating means for locking the base and lever together.

4. A fastening clip for securing a laced shoe onto a foot as set forth in claim 3 in which the means for locking the base and lever together consists of patches of interlocking hook and loop fibers on the clip base and on the clip lever which when pressed together lock the clip base and clip lever together along the side of the shoe.

* * * * *